US009908662B2

(12) United States Patent
Campagna et al.

(10) Patent No.: US 9,908,662 B2
(45) Date of Patent: Mar. 6, 2018

(54) COLLAPSIBLE PACKAGING SLEEVE FOR ATTACHING TO A BASE AND CONTAINER FORMED THEREFROM

(71) Applicant: FCA, LLC, Moline, IL (US)

(72) Inventors: Jeff Campagna, Moline, IL (US); Jacob Goodman, Moline, IL (US); Michael Thompson, Moline, IL (US)

(73) Assignee: FCA, LLC, Moline, IL (US)

( * ) Notice: Subject to any disclaimer, the term of this patent is extended or adjusted under 35 U.S.C. 154(b) by 0 days.

(21) Appl. No.: 15/232,534

(22) Filed: Aug. 9, 2016

(65) Prior Publication Data

US 2016/0347500 A1 Dec. 1, 2016

Related U.S. Application Data

(62) Division of application No. 13/784,482, filed on Mar. 4, 2013, now abandoned.

(51) Int. Cl.
*B65D 19/00* (2006.01)
*B65D 19/16* (2006.01)
(Continued)

(52) U.S. Cl.
CPC ..... *B65D 19/16* (2013.01); *B65D 19/44* (2013.01); *E05D 1/02* (2013.01); *E05D 9/005* (2013.01);
(Continued)

(58) Field of Classification Search
USPC ..... 206/386, 600
See application file for complete search history.

(56) References Cited

U.S. PATENT DOCUMENTS 3,323,674 A * 6/1967 Nist, Jr. ..... B65D 9/24 217/12 R
3,348,723 A * 10/1967 Wilson ..... B65D 19/12 108/53.5
(Continued)

FOREIGN PATENT DOCUMENTS

DE 202007003126 5/2007
EP 0169950 * 7/1984
(Continued)

OTHER PUBLICATIONS

Partial European Search Report for European Application No. EP14157727, dated Jun. 5, 2014, 6 pages.
(Continued)

*Primary Examiner* — Jacob K Ackun
(74) *Attorney, Agent, or Firm* — McAndrews, Held & Malloy, Ltd.

(57) ABSTRACT

The present invention provides a packaging sleeve that can be attached to a base, such as a pallet, to form a container. The container can be used for the shipping and/or storage of goods. The packaging sleeve comprises latching members by which the packaging sleeve may be securably attached to the base in a manner of seconds. The present invention also provides a collapsible packaging sleeve having four panels, each panel being hingedly connected to two adjacent panels by non-metallic hinges. By operation of the non-metallic hinges, the box can be collapsed such that the packaging sleeve lays substantially flat, rendering it suitable for easy, out of the way storage and enhancing warehouse efficiency. The non-metallic hinges are designed to have a long life span and to be operable with panels having various dimensions.

11 Claims, 5 Drawing Sheets

(51) Int. Cl.
*E05D 1/02* (2006.01)
*E05D 9/00* (2006.01)
*B65D 19/44* (2006.01)

(52) U.S. Cl.
CPC ..... *B65D 2519/00029* (2013.01); *B65D 2519/00064* (2013.01); *B65D 2519/0091* (2013.01); *B65D 2519/00099* (2013.01); *B65D 2519/00169* (2013.01); *B65D 2519/00203* (2013.01); *B65D 2519/00243* (2013.01); *B65D 2519/00273* (2013.01); *B65D 2519/00293* (2013.01); *B65D 2519/00323* (2013.01); *B65D 2519/00333* (2013.01); *B65D 2519/00497* (2013.01); *B65D 2519/00601* (2013.01); *B65D 2519/00661* (2013.01); *B65D 2519/00711* (2013.01); *E05Y 2900/602* (2013.01); *Y10T 16/525* (2015.01)

(56) References Cited

U.S. PATENT DOCUMENTS 3,664,570 A 5/1972 Kupersmit
3,941,271 A 3/1976 Zarges et al.
3,955,320 A 5/1976 Serovy et al.
4,000,827 A 1/1977 Emery
4,050,604 A 9/1977 Flanders
4,069,938 A 1/1978 Palte et al.
4,083,464 A 4/1978 Burnett
4,089,467 A 5/1978 Makowicki
4,171,058 A 10/1979 Collins
4,221,296 A * 9/1980 Fell ..... B65D 19/16 206/600
4,560,257 A 12/1985 Otema
4,576,300 A 3/1986 Kedzior
4,643,314 A 2/1987 Kidd
4,673,087 A 6/1987 Webb
4,793,507 A 12/1988 Delplanque
4,828,132 A 5/1989 Francis, Jr. et al.
4,953,730 A 9/1990 Prime et al.
5,050,536 A 9/1991 Baker
5,123,541 A 6/1992 Giannini et al.
5,360,128 A 11/1994 Hessenthaler
5,535,909 A 7/1996 Phillip
5,720,403 A 2/1998 Sawyer
5,743,421 A 4/1998 Gonzalez et al.
5,829,595 A 11/1998 Brown et al.
5,934,638 A * 8/1999 Provot ..... B65D 19/0016 108/55.1
6,241,148 B1 6/2001 Schwimmer
6,314,626 B1 11/2001 Becker
6,415,927 B1 7/2002 Stone et al.
6,454,111 B1 9/2002 Berryhill
6,902,061 B1 6/2005 Elstone
7,455,179 B2 11/2008 Bringard et al.
7,703,632 B2 4/2010 Kochanowski
7,823,738 B2 11/2010 Wang
7,963,397 B2 6/2011 Seagle et al.
8,308,018 B2 11/2012 Kochanowski
8,608,003 B2 12/2013 Uno
2007/0251857 A1 11/2007 Watanabe
2008/0312054 A1 12/2008 Boland
2011/0132801 A1 6/2011 Elder

FOREIGN PATENT DOCUMENTS

EP 0449062 * 3/1991
EP 0453170 * 4/1991
EP 2676893 12/2013
FR 2769293 4/1999
GB 2038278 * 12/1978
GB 2038278 7/1980
GB 2179631 3/1987
WO WO 94/243007 * 10/1994
WO 2004043802 5/2004

OTHER PUBLICATIONS

European Search Report in European Application No. EP14157727, dated Oct. 9, 2014, 6 pages.

* cited by examiner

COLLAPSIBLE PACKAGING SLEEVE FOR ATTACHING TO A BASE AND CONTAINER FORMED THEREFROM

This application claims priority to U.S. patent application Ser. No. 13/784,482, filed on Mar. 4, 2013, the entirety of which is hereby incorporated by reference.

BACKGROUND OF THE INVENTION

1. Field of the Invention

The present invention relates generally to containers that may be used for shipping and/or storage of a variety of goods. More particularly, an embodiment of the present invention relates to a packaging sleeve for attachment to a base, such as a pallet, and the container that is formed therefrom.

2. Description of the Related Art

Wood containers are typically attached to pallets by bands, nails, or other like means. While these practices provide effective securement of a wood container to a pallet, they are time-consuming and labor intensive. The securement of a conventional wood container to a pallet typically takes a number of minutes, with most requiring greater than five minutes. Accordingly, the attachment of conventional wood containers to pallets increases the time and costs of shipping and storing goods.

Collapsible wood containers reduce storage space and freight costs yet can be durable enough to hold goods weighing several thousand pounds. However, collapsible wood containers typically utilize metal hinges, which wear out after several cycles of collapse and expansion of the container. Metal hinges also have sharp edges, which can render the collapsible containers dangerous to workers.

SUMMARY OF THE INVENTION

The present invention provides a packaging sleeve that can be attached to a base, such as a pallet, to form a container. Unlike conventional wood containers, the container of the present invention may be formed by attachment of the packaging sleeve to the base in a manner of seconds. When not being used, the container may be broken down by separation of the packaging sleeve from the base. Break down of the container can also be accomplished in a matter of seconds. Once detached from the base, the packaging sleeve may preferably be collapsed and efficiently stored.

The packaging sleeves of the present invention can be built to a variety of dimensions. Thus the packaging sleeves of the present invention can provide containers that are suitable for the shipment and/or storage of goods of different weights and sizes.

An embodiment of the present invention comprises a packaging sleeve having latching members by which the packaging sleeve may be quickly attached to a base, such as a pallet, in a manner of seconds. The packaging sleeve can be detached from a base to break down the shipping container in a matter of seconds. The speed with which the collapsible packaging sleeve of an embodiment of the present invention may be attached to a base to form a shipping container and detached from the base to breakdown the shipping container provides a significant advantage over conventional collapsible wood containers.

Another embodiment of the present invention comprises a collapsible packaging sleeve having four panels, each panel being hingedly connected to two adjacent panels to form a box. By operation of the hinges, the box can be collapsed such that the packaging sleeve lays substantially flat, rendering the packaging sleeve suitable for easy, out of the way storage and enhancing warehouse efficiency. On average, storage of the collapsible packaging sleeve increases warehouse space by about 70%. In an embodiment of the present invention, the hinges are not metallic. Rather, the hinges are formed of a plastic material, which is less costly and less dangerous than conventional metal hinges. The non-metallic hinges are also designed so as to be more durable and more versatile than conventional hinges. Due to the unique design of the non-metallic hinges, the hinges of embodiments of the present invention undergo less stress during normal operation and thus have a longer life span than typical metal hinges. The unique design of the non-metallic hinge also provides that a single hinge is extremely versatile and may be used with panels of varying thickness and dimensions to form containers of various sizes.

Embodiments of the present invention provide a packaging sleeve and a container having a long lifespan and a very low cost of manufacture. Embodiments of the present invention also provide a packaging sleeve that can be quickly attached to a base for the rapid construction of a shipping container and just as quickly detached from a base for the rapid breakdown of the shipping container.

For a better understanding of the invention, its operating advantages, and the specific objects attained by its uses, reference should be had to the accompanying drawings and descriptive matter in which there is illustrated a preferred embodiment of the invention.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1A:
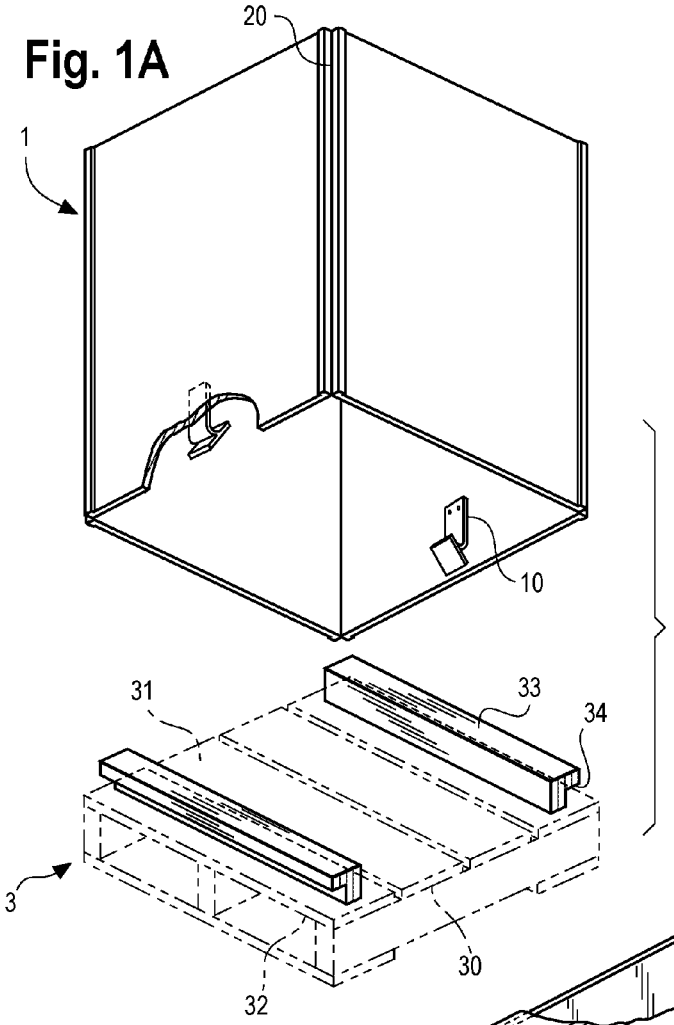
FIG. 1A is a perspective view, partly in section, of an embodiment of the packaging sleeve having latching members on opposing panels and having the panels hingedly connected to one another by a non-metallic hinge; and an embodiment of a base having mounting blocks configured for interaction with the latching members of the packaging sleeve.
Figure 1B:
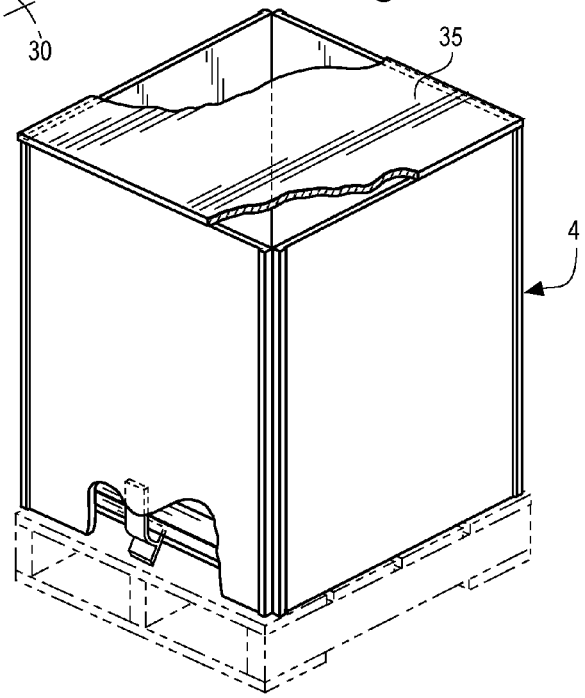
FIG. 1B is a perspective view, partly in section, of an embodiment of the container formed by securement of the packaging sleeve to a base.
Figure 2:
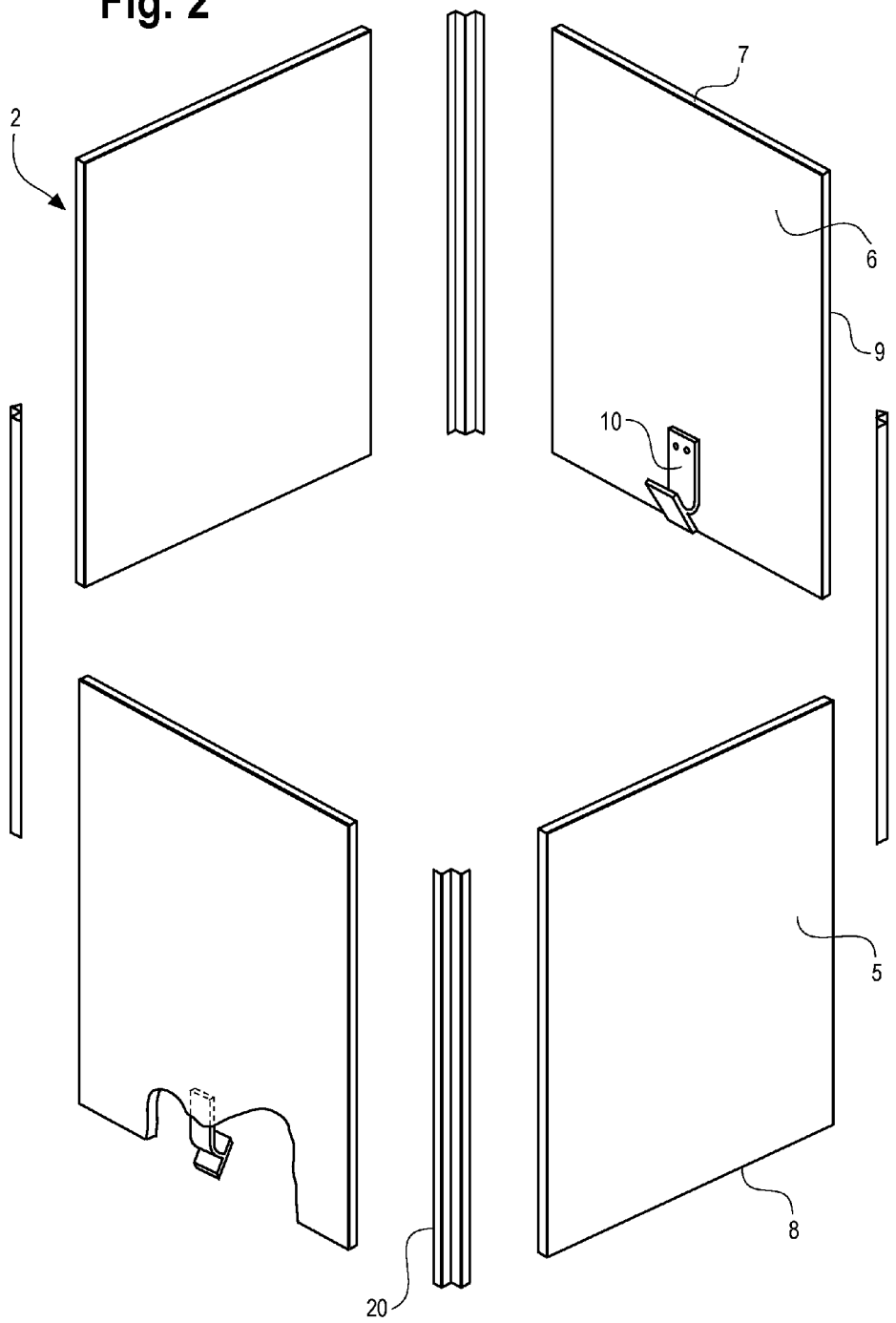
FIG. 2 is an exploded perspective view, partly in section, of an embodiment of the packaging sleeve having latching members on opposing panels and having the panels hingedly connected to one another by a non-metallic hinge.
Figure 3A:
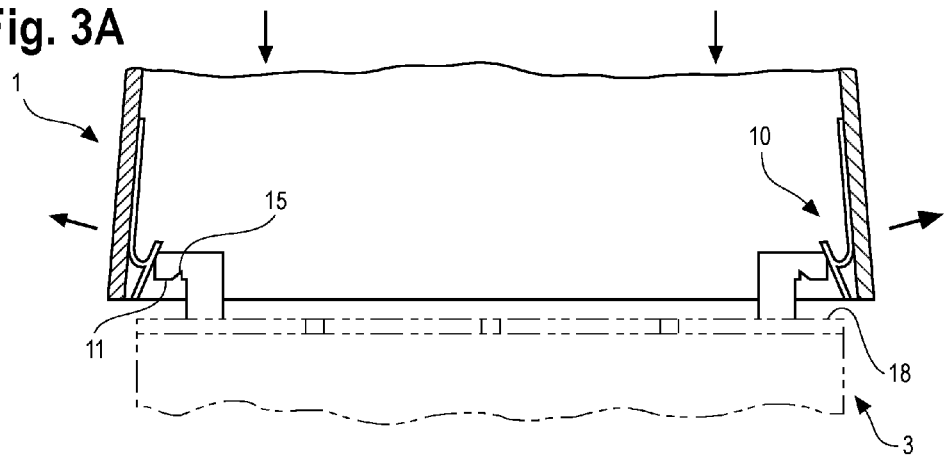
FIG. 3A is a side elevation view, partly in section, of an embodiment of the packaging sleeve showing a mounting of the packaging sleeve on a base having mounting blocks.
Figure 3B:
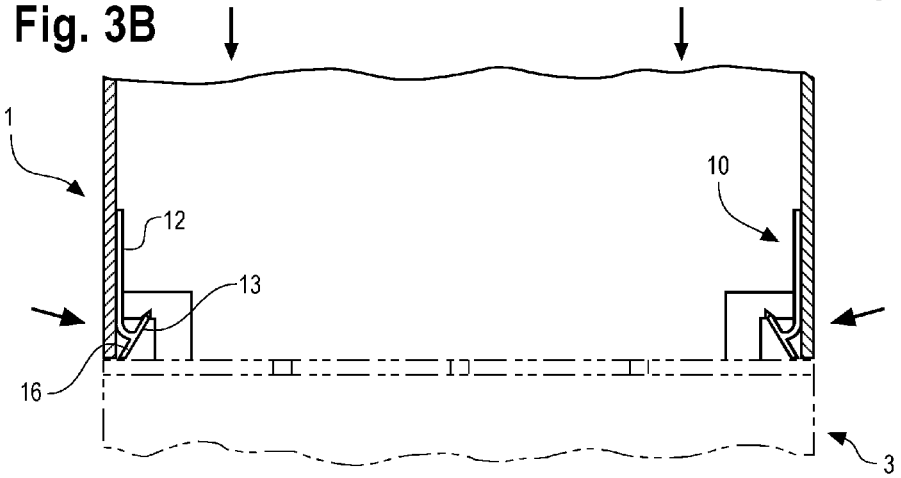
FIG. 3B is a side elevation view, partly in section, of an embodiment of the packaging sleeve showing the interaction of the latching member with a downward-facing surface of a base to bring about the secure attachment of the packaging sleeve to the base.

A packaging sleeve 1 comprises a set of panels 2 that, when attached to a base 3, is operable to form a container 4. Typically, a packaging sleeve 1 comprises four panels 2 that can be configured to relate to one another to form the walls of a box. Each of the panels 2 comprises an exterior surface 5, an interior surface 6, a top edge 7, a bottom edge 8 and a pair of side edges 9. Preferably, the panels 2 are each made out of wood, more preferably engineered wood such as plywood, oriented strand board, wafer board, corrugated board, structured panels, and the like. The strength, size, and thickness of the material may be selected depending on the shipping requirements for a particular set of goods. In this way, custom packaging sleeves may be designed for any shipping application.

In one aspect of the present invention, the packaging sleeve 1 comprises latching members 10 that are operable to attach the packaging sleeve to a base 3. As illustrated, the latching members 10 are preferably affixed to the interior surfaces 6 of non-adjacent panels 2. The latching members 10 may be confined within the dimensions of the panels 2 or they may extend below the bottom edges of the panels 8. A pair of latching members 10 is preferably utilized with a typical packaging sleeve 1 having four panels 2. The latching members 10 may be formed out of any material that is of suitable strength for securing the packaging sleeve 1 to the base 3. Strong yet inexpensive materials, such as extrudable or moldable plastics are preferred. Polypropylene is a particularly preferred material, but any plastic resin, metal, or composite material can be used.

The latching members 10 are operable to interact with a base 3 so as to attach and secure the packaging sleeve 1 to the base. Each latching member 10 is operable to interact with a downward-facing surface of a base 11 to attach a panel 2 to the base 3. When both of the latching members 10 are placed into interaction with downward-facing surfaces of the base 11, the packaging sleeve 1 is securely attached to the base 3. Additionally, where the packaging sleeve 1 is a collapsible packaging sleeve, such as is described herein, the interaction of the latching members 10 with downward-facing surfaces of the base 11 fixes the collapsible packaging sleeve to its open configuration.

Each latching member 10 comprises at least a body 12 and a hook element 13. The body 12 is affixed to a panel 2. In a preferred embodiment, the body 12 is affixed to the interior surface of the panel 6. The latching member 10 may be affixed to the panels 2 by any suitable manner, including screws, nails, staples, rivets, and other fasteners. The hook element 13 extends from the body 12 and has an upper edge 14, the upper edge being capable of interacting with the downward-facing surface of the base 11 so as to attach and secure the packaging sleeve 1 to the base 3. In a preferred embodiment, the downward-facing surface of the base 11 comprises a groove or dado 15, into which the upper edge of the hook element 14 may cooperate.

In a preferred embodiment, each of the latching members 10 also comprises a buttress element 16 that is operable to stabilize the packaging sleeve 1 on the base 3 and prevent the packaging sleeve from being unintentionally dislodged from the base. For example, when an upward force is applied to the packaging sleeve 1, the hook element 13 may flex. If enough force is applied, the hook element 13 could flex to a degree that is capable of disturbing its interaction with the downward-facing surface of the base 11. A buttress element 16 is operable to prevent the hook element 13 from flexing to such an undesirable degree. Thus, when a hook element 13 reaches a certain amount of flex, a buttress element 16 interacts with a surface of the base to prevent the hook element from flexing beyond that certain amount. Thus, once a packaging sleeve 1 is attached to a base 3 to form a container 4, the container may be picked up by the packaging sleeve 1, for instance by gripping the top edge of the panels 7 and pulling up, without the packaging sleeve becoming dislodged from the base.

For example, in embodiment illustrated in the Figures, each latching member 10 comprises a buttress element 16 having a lower edge 17, the lower edge being capable of interacting with an upward-facing surface of the base 18 when the hook element 13 flexes in response to an upward force. The interaction of the lower edge of the buttress element 17 with the upward-facing surface of the base 18 prevents further flexing of the hook element 13. Through this interaction, the buttress element 16 prevents the hook element 13 from flexing to a degree that could result in unintentional removal of the packaging sleeve 1 from the base 3.

Figure 6:
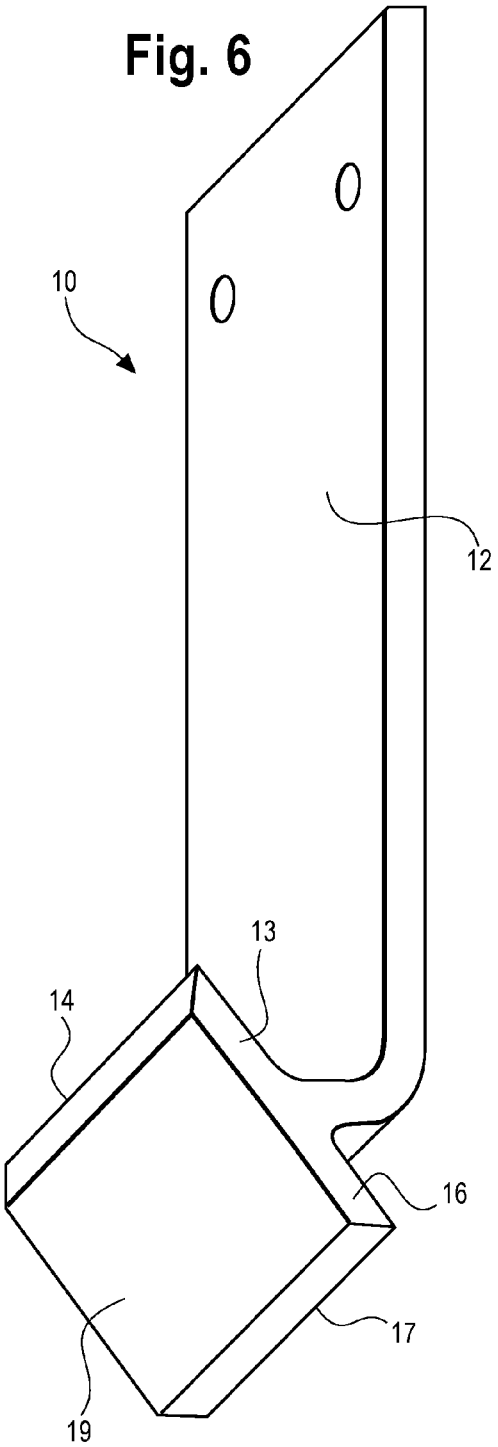
FIG. 6 is a perspective view of an embodiment of the latching member.

In the embodiment illustrated in FIG. 6, the upper edge of the hook element 14 is disposed inwardly of the lower edge of the buttress element 17. The buttress element 16 of this embodiment provides the additional benefit that a force having both a downward and outward component, such as may result from the shifting of goods during transportation, will have to overcome the interaction of the lower edge of the buttress element 17 with the upward-facing surface of the base 18, in order to result in an unintentional removal of the packaging sleeve from the base. In a particularly preferred design, the latching member 10 may comprise a surface 19 that spans from the upper edge of the hook element 14 to the lower edge of the buttress element 17.

Figure 4:
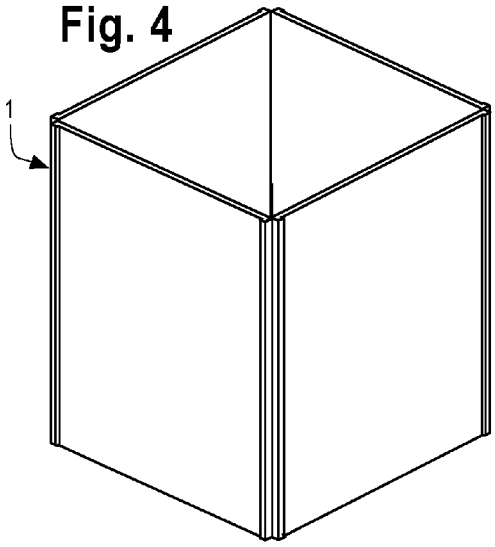
FIG. 4 is a perspective view of an embodiment of the collapsible packaging sleeve in an open configuration.
Figure 5:
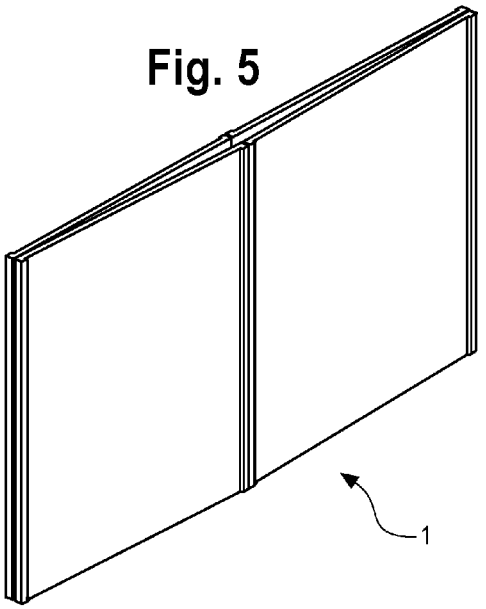
FIG. 5 is a perspective view of an embodiment of the collapsible packaging sleeve in a collapsed configuration.

In another aspect of the present invention, the packaging sleeve 1 may be collapsible. An embodiment of the collapsible packaging sleeve 1 comprises four panels 2, each panel being hingedly connected to two adjacent panels such that together the panels may be shifted between an open configuration, in which the panels form the walls of a box, and a closed configuration, in which the panels lay substantially flat. An example of the collapsible packaging sleeve 1 in an open configuration is illustrated in FIG. 4 and an example of the collapsible packaging sleeve in a closed configuration is illustrated in FIG. 5.

Preferably, the panels 2 are hingedly connected to one another by a non-metallic hinge 20. The non-metallic hinge 20 is preferably made of a plastic material. Polypropylene is a particularly preferred material. The non-metallic hinges 20 are preferably formed by an extrusion process. For example, the non-metallic hinges 20 can be formed of a single sheet of extruded plastic. The non-metallic hinge 20 is designed so that it can be affixed to only one side of a panel 2. Thus, the non-metallic hinges 20 are preferably affixed to the panels 2 only on the panel exterior surfaces 5, as illustrated in the Figures. The non-metallic hinges 20 may be affixed to the panels 2 by any suitable manner, including staples, rivets, and other fasteners.

Figure 7:
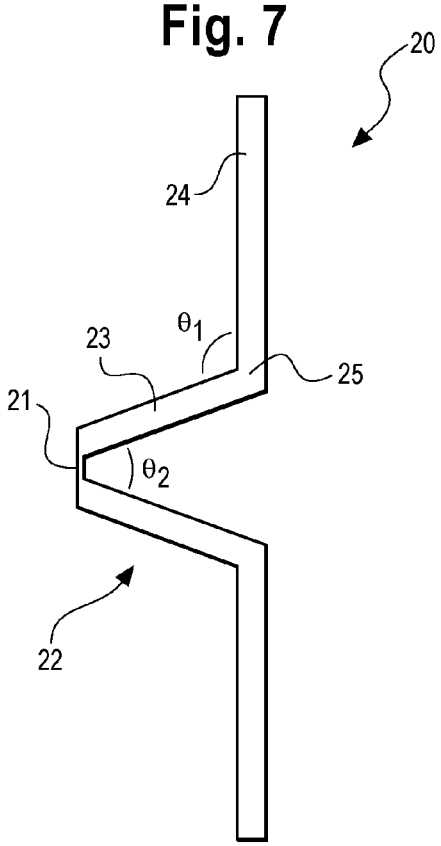
FIG. 7 is an end view of an embodiment of the non-metallic hinge in its rest position.

The non-metallic hinge 20 of an embodiment of the present invention is illustrated in FIG. 7. The non-metallic hinge 20 preferably comprises a single piece of plastic that is designed to have a flex point 21 in or about the center. On each side of the flex point 21, the non-metallic hinge 20 comprises an arm 22. The arm 22 has an inner portion 23 and an outer portion 24, the two portions being separated by a pinch point 25 to form an angled relationship with one another. The angle $\theta_1$ formed by the inner and outer portion of the arm 23, 24 is preferably between 90° and 130°. The angle $\theta_1$ formed by the inner and outer portion of the arm 23, 24 is more preferably between 100° and 120°. The angle $\theta_1$ formed by the inner and outer portion of the arm 23, 24 is more preferably between 105° and 115°. The angle $\theta_1$ formed by the inner and outer portion of the arm 23, 24 is more preferably about 110°.

The non-metallic hinge 20 is designed to have a rest position, in which the flex point undergoes zero stress. The angle $\theta_2$ formed by the inner arms 23 about the flex point 21 in the rest position is preferably between 20° and 90°. The angle $\theta_2$ formed by the inner arms 23 about the flex point 21 in the rest position is more preferably between 20° and 80°. The angle $\theta_2$ formed by the inner arms 23 about the flex point 21 in the rest position is more preferably between 20° and 70°. The angle $\theta_2$ formed by the inner arms 23 about the flex point 21 in the rest position is more preferably between 20° and 60°. The angle $\theta_2$ formed by the inner arms 23 about the flex point 21 in the rest position is more preferably between 30° and 50°. The angle $\theta_2$ formed by the inner arms 23 about the flex point 21 in the rest position is more preferably between 35° and 45°. The angle $\theta_2$ formed by the inner arms 23 about the flex point 21 in the rest position is more preferably about 40°.

Figure 8:
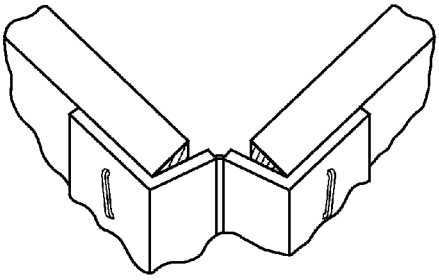
FIG. 8 is a perspective view of an embodiment of the packaging sleeve in an open configuration, showing the position of the non-metallic hinge.
Figure 10:
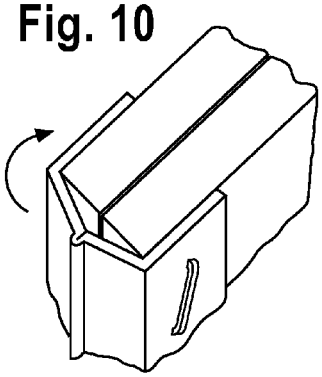
FIG. 10 is a perspective view of an embodiment of the packaging sleeve in a collapsed configuration, showing the non-metallic hinge in the second of two positions.
Figure 9:
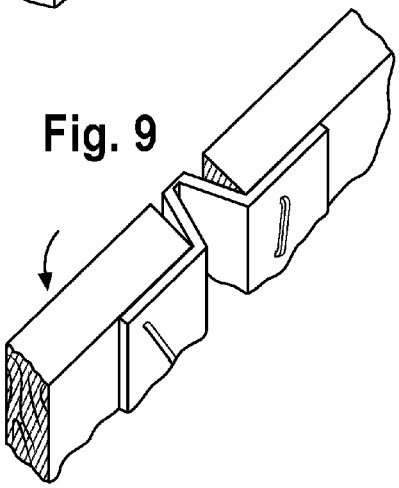
FIG. 9 is a perspective view of an embodiment of the packaging sleeve in a collapsed configuration, showing the non-metallic hinge in the first of two positions.

The movement of the non-metallic hinge 20 about the flex point 21 to place the collapsible packaging sleeve 1 is in its open and closed configuration is illustrated in FIGS. 8-10. The non-metallic hinge 20 is designed to limit the stress that is applied to the flex point 21 when the collapsible packaging sleeve 1 is in its open and collapsed configurations.

When the collapsible packaging sleeve 1 is placed in a collapsed configuration, each of the non-metallic hinges 20 takes either the position illustrated in FIG. 9 or the position illustrated in FIG. 10, depending on the direction in which the packaging sleeve is collapsed. Because the panels 2 making up the packaging sleeve 1 are largely the same, repeated collapsing of the packaging sleeve over its lifetime is likely to result in each non-metallic hinge 20 taking the position illustrated in FIG. 9 about half of the time and the position illustrated in FIG. 10 about half of the time.

The non-metallic hinges 20 that take the position illustrated in FIG. 9 flex about the flex point 21 such that the inner portions of the arms 23 are disposed between the side edges of the adjacent panels 9. In this position, the inner portions of the hinge arms 23 form an angle $\theta_2$ about the flex point 21, bringing the outer portions of the arms 24, and the adjacent panels 2 to which the outer portions of the arms are affixed, into the same or substantially the same plane. The angle $\theta_2$ about the flex point 21 is preferably greater than 0° and less than 180°. The angle $\theta_2$ about the flex point 21 is more preferably between 10° and 110°. The angle $\theta_2$ about the flex point 21 is more preferably between 20° and 90°. The angle $\theta_2$ about the flex point 21 is more preferably between 20° and 80°. The angle $\theta_2$ about the flex point 21 is more preferably between 20° and 70°. The angle $\theta_2$ about the flex point 21 is more preferably between 20° and 60°. The angle $\theta_2$ about the flex point 21 is more preferably between 30° and 50°. The angle $\theta_2$ about the flex point 21 is more preferably between 35° and 45°. The angle $\theta_2$ about the flex point 21 is more preferably about 40°.

Due to the design of the non-metallic hinge 20, the angle $\theta_2$ formed by the flex point 21 in the position illustrated in FIG. 9 may be the same or substantially the same as the angle formed by the flex point when the non-metallic hinge 20 is in the rest position. In this way, the flex points 21 of the non-metallic hinges 20 in this position undergo little to no stress when the collapsible packaging sleeve 1 is placed into its collapsed configuration. As a result, the non-metallic hinges 20, and accordingly, the collapsible packaging sleeve 1 have an increased life-span.

When the collapsible packaging sleeve 1 is placed in an open configuration, the non-metallic hinges 20 each take the position illustrated in FIG. 8. In this position, the adjacent panels 2 are substantially perpendicular to one another and the flex point 21 and inner portions of the hinge arms 23 are disposed between the side edges 9 of the adjacent panels. In this position, the angle $\theta_2$ about the flex point 21 is preferably between 90° and 180°. The angle $\theta_2$ about the flex point is more preferably between 100° and 170°. The angle $\theta_2$ about the flex point is more preferably between 110° and 160°. The angle $\theta_2$ about the flex point is more preferably between 110° and 150°. The angle $\theta_2$ about the flex point is more preferably between 120° and 140°. The angle $\theta_2$ about the flex point is more preferably about 130°.

While the adjacent panels 2 are placed into a configuration in which they are substantially perpendicular with one another, it is not required that the flex point 21 form a right angle between the inner portions of the hinge arms 23. Rather, the angle $\theta_2$ preferably flexes to an angle other than 90° to place the collapsible packaging sleeve 1 in its open configuration. Where the flex point 21 of the non-metallic hinge 20 is flexed at an angle other than 90°, the hinge is able to react to outward forces, such as may result from the movement of goods within a shipping container, by bending outwardly. The ability of the non-metallic hinges 20 to provide an amount of "give" in response to forces that act upon it limits the stress that is placed on the flex point 21. This increases the life-span of the non-metallic hinges 20, and accordingly, the collapsible packaging sleeve 1.

Additionally, by providing that the flex point 21 of a non-metallic hinge 20 need not flex to a right angle in order to place the collapsible packaging sleeve 1 in an open configuration, the non-metallic hinge 20 may be used with panels 2 having varying dimensions and thicknesses. Accordingly, a single non-metallic hinge 20 may be used to create collapsible packaging sleeves 1 and containers 4 having varying dimensions. The non-metallic hinges 20 of embodiments of the present invention thus provide a degree of versatility not achieved with conventional hinges. This versatility results in lowered manufacturing costs, making the collapsible packaging sleeves 1 inexpensive and more readily expendable.

In a preferred embodiment, the non-metallic hinge 20 also comprises a rip-stop 26. Although the non-metallic hinge 20 is designed to limit the stress that is placed on the flex point 21, such stress is an inherent aspect of a collapsible container. The most prevalent failure of the non-metallic hinge 20 begins with a separation, or ripping, at an end of the flex point 27. The separation that begins at the end of the flex point 27 then propagates down the length of the flex point 21, resulting in failure of the hinge 20. A rip-stop 26 is operable to impede the propagation of such a separation, such that a ripping at the end of the flex point 27 is less likely to result in failure of the non-metallic hinge 20. Preferably, a rip-stop 26 is located at each end of the non-metallic hinge 27.

Figure 11:
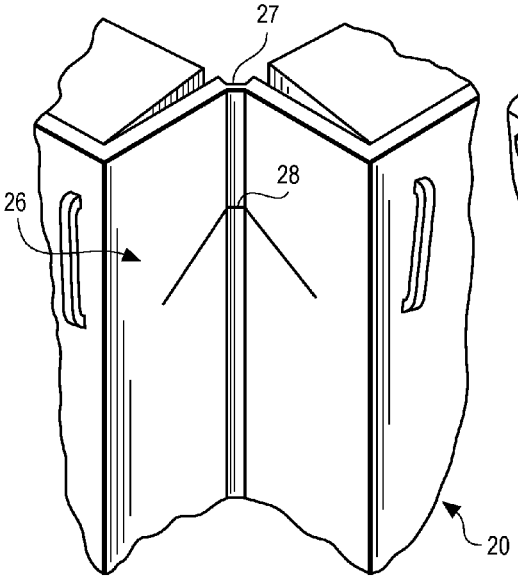
FIG. 11 is a perspective view of an embodiment of the packaging sleeve having a non-metallic hinge comprising a rip-stop feature.

An embodiment of a rip-stop 26 is illustrated in FIG. 11. In this embodiment, the rip-stop 26 comprises a V-shaped notch that is cut into the non-metallic hinge 20 about the flex point 21. The point of the V-shaped notch 28 is directed toward the end of the flex point 27. The V-shaped notch preferably forms an angle $\theta_3$ between 30° and 60°. More preferably, the V-shaped notch forms an angle $\theta_3$ between 40° and 50°. More preferably the V-shaped notch forms an angle, $\theta_3$, of about 45°. The rip-stop 26 is preferably located about one inch from an end of the flex point 27, although the exact location is not critical. The V-shaped notch may be cut into the non-metallic hinge 20 by any suitable manner, including for example, saw, razor blade, knife, and the like.

Figure 12:
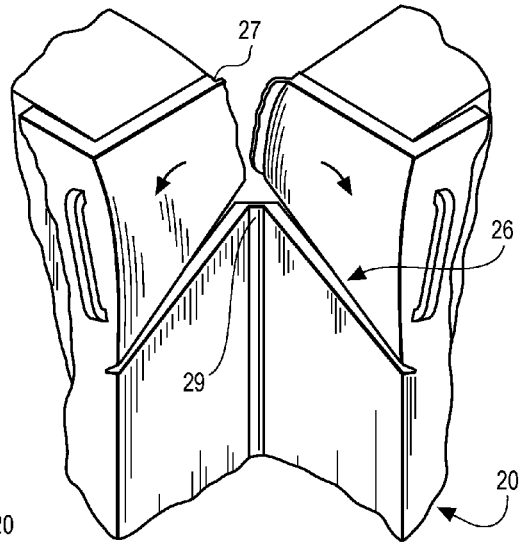
FIG. 12 is a perspective view of an embodiment of the packaging sleeve having a non-metallic hinge comprising a rip-stop feature, showing the rip-stop feature limiting the propagation of a tear from the end of the flex point.

The action of the rip-stop 26 in limiting the propagation of a rip is illustrated in FIG. 12. When a separation of the material about the flex point 21 reaches the V-shaped notch, the notch directs the forces that give rise to the separation away from the flex point 21 and into the arms of the non-metallic hinge 22. The flex point at the notch forms a tip 29. The forces required to separate the material of the non-metallic hinge 20 about the flex point 21 at this tip 29 are increased. Accordingly, the tip 29 limits the separation of the material of the non-metallic hinge 20 about the flex point. In this manner, the propagation of the rip is halted and failure of the non-metallic hinge 20 is prevented.

In another aspect of the present invention, the packaging sleeve 1 of the present invention is attached to a base 3 to form a container 4. The base 3 may be, for example, a pallet or skid. In a preferred embodiment of the present invention, the base 3 is a wooden pallet comprising deck boards 30 that form an upper support surface 31. The packaging sleeve 1 may be secured to the base 3 by the interaction of the hook element of the latching members 13 with the bottom surfaces of the deck boards 32. In another embodiment, the base 3 may be specially configured to provide a latching surface for the attachment of a packaging sleeve 1. For example, in the embodiment illustrated in the Figures, the base 3 comprises a mounting block 33 on each side. Each mounting block 33 comprises a downward-facing latching surface 34 that extends over a portion of the upper support surface of the pallet 31. The latching surface 34 is configured for the interaction with a hook element of a latching member 13. Preferably, the latching surface 34 comprises a groove or dado 15, into which the upper edge of the hook element 13 cooperates to yield an improved securement of the packaging sleeve 1 to the base 3. In this embodiment, the upper support surface of the pallet 31 acts as the upward-facing surface 18 with which a buttress element 16 of the latching member interacts.

In a preferred embodiment, a container 4 is constructed by the attachment of a packaging sleeve 1 having at least a pair of latching members 10 to a base 3. In this embodiment, the packaging sleeve 1 may be attached to the base 3 in a manner of seconds. For example, the packaging sleeve 1 is capable of being attached to a base 3 to form a container 4 in less than ten seconds. More preferably, the packaging sleeve 1 is capable of being attached to a base 3 to form a container 4 in less than five seconds. More preferably, the packaging sleeve 1 is capable of being attached to a base 3 to form a container 4 in less than four seconds. More preferably, the packaging sleeve 1 is capable of being attached to a base 3 to form a container 4 in less than three seconds. More preferably, the packaging sleeve 1 is capable of being attached to a base 3 to form a container 4 in less than two seconds.

The shipping and storage container 4 of an embodiment of the present invention is preferably constructed by first placing the hook element of one of the latching members 13 under a first downward-facing surface of the base 11 and into interaction with the first downward-facing surface of the base and then placing the hook element of at least a second of the latching members 13 under a second downward-facing of the base 11 and into interaction with the second downward-facing surface of the base. One can easily attach the packaging sleeve 1 to a base 3 in a single fluid motion that requires little effort. For instance, one can easily attach the packaging sleeve 1 to a base 3 by gripping the top edges of the two panels 7 bearing the two latching members 10 and directing the panels in a direction to bring about the interaction of the latching members 10 and the downward-facing surfaces of the base 11. Preferably, when each of the latching members 10 is interacting with a downward-facing surface of the base 11, the resulting container 4 can be picked up by the top edge of the panels 7 without separation of the packaging sleeve 1 and the base 3.

Once the goods are placed in the shipping container 4, a cover 35 may be attached to the container by any suitable manner, such as nails, staples, rivets, and other fasteners. The cover 35 preferably comprises a wood product such as plywood, oriented strand board, wafer board, corrugated board, structured panels, and the like. For many shipping and storage applications, a cover 35 is optional but not necessary.

In a preferred embodiment, the shipping and storage container 4 is broken down by the detachment of a packaging sleeve 1 having at least a pair of latching members 10 from a base 3. In this embodiment, the packaging sleeve 1 may be detached from the base 3 in a manner of seconds. For example, the packaging sleeve 1 is capable of being detached from a base 3 to break down a container 4 in less than ten seconds. More preferably, the packaging sleeve 1 is capable of being detached from a base 3 to break down a container 4 in less than five seconds. More preferably, the packaging sleeve 1 is capable of being detached from a base 3 to break down a container 4 in less than four seconds. More preferably, the packaging sleeve 1 is capable of being detached from a base 3 to break down a container 4 in less than three seconds. More preferably, the packaging sleeve 1 is capable of being detached from a base 3 to break down a container 4 in less than two seconds.

The shipping and storage container 4 of an embodiment of the present invention is preferably broken down by first removing the interaction between the hook element of a first latching member 13 and a first downward-facing surface of the base 11 and then removing the interaction between the hook element of a second latching member 13 and a second downward-facing surface of the base 11. The disruption of the interaction between the hook element of a latching member 13 and a downward-facing surface of the base 11 is preferably accomplished by the application of a downward force to the panel 2 that bears the latching member 10 followed by the application of an outward force to the panel that bears the latching member. Once can easily detach the packaging sleeve 1 from a base 3 in a single fluid motion that requires little effort. For example, one can easily detach the packaging sleeve 1 from a base 3 by gripping the top edges of the two panels 7 bearing the two latching members 10 and directing the panels 2 in a direction to remove the interaction between the latching members 10 and the downward-facing surfaces of the base 11. Preferably, the packaging sleeve 1 can then be collapsed and efficiently stored for repeated uses.

It can be seen that the described embodiments provide a unique and novel mounting assembly that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A container comprising:

(1) a collapsible packaging sleeve attached to a base to form a container comprising a. four panels, each panel being hingedly connected to adjacent panels, and b. at least two latching members that are operable to attach the packaging sleeve to the base so as to secure the packaging sleeve to the base;

and (2) a base, wherein the base comprises a pallet having an upper support surface, and at least two mounting blocks;

wherein each latching member comprises a hook element having an upper edge that interacts with a downward-facing surface of one of the mounting blocks that extends over a portion of the upper support surface of the pallet;

a buttress element having a lower edge that interacts with an upward-facing surface of the base to stabilize the packaging sleeve on the base; and a surface that spans between the upper edge of the hook element and the lower edge of the buttress element, the upper edge of the hook element being disposed inward from the lower edge of the buttress element.

2. The container of claim 1 wherein the hook element interacts with a groove or dado in the downward-facing surface.

3. The container of claim 1, in which the upward-facing surface of the base is the upper support surface of the pallet.

4. The container of claim 1 wherein the at least two latching members are affixed to the interiors of two non-adjacent panels.

5. The container of claim 1 wherein the latching members are configured of a plastic material.

6. The container of claim 1 wherein the latching members are configured of polypropylene.

7. The container of claim 1 wherein the each of the panels is hingedly connected to adjacent panels by a non-metallic hinge.

8. The container of claim 7 wherein the non-metallic hinge comprises a single sheet of plastic having a flex point and a pair of arms, each arm having an inner portion and an outer portion that are angled with respect to one another.

9. The container of claim 8, wherein flexing of the non-metallic hinge about the flex point to bring the outer portions of the arms into a perpendicular relationship with one another places the inner portions of the arms at an angular relationship of other than 90 degrees.

10. The container of claim 1, wherein the pallet is a wooden pallet comprising deck boards that form the upper support surface.

11. The container of claim 1, wherein the base comprises a wooden pallet having two mounting blocks.

* * * * *